US010967949B2

(12) United States Patent
Odorico et al.

(10) Patent No.: US 10,967,949 B2
(45) Date of Patent: Apr. 6, 2021

(54) SEAWATER INTAKE RISER INTERFACE WITH VESSEL HULL

(71) Applicant: Single Buoy Moorings, Inc., Marly (CH)

(72) Inventors: Julien Odorico, Houston, TX (US); Jack Pollack, Houston, TX (US)

(73) Assignee: SINGLE BUOY MOORINGS, INC., Marly (CH)

( * ) Notice: Subject to any disclaimer, the term of this patent is extended or adjusted under 35 U.S.C. 154(b) by 704 days.

(21) Appl. No.: 15/809,580

(22) Filed: Nov. 10, 2017

(65) Prior Publication Data

US 2018/0127079 A1 May 10, 2018

Related U.S. Application Data

(60) Provisional application No. 62/420,188, filed on Nov. 10, 2016.

(51) Int. Cl.

| | |
|---|---|
| ***E21B 17/01*** | (2006.01) |
| ***E21B 19/00*** | (2006.01) |
| ***B63B 13/00*** | (2006.01) |
| ***B63J 2/00*** | (2006.01) |
| ***B63J 2/12*** | (2006.01) |
| *B63B 35/44* | (2006.01) |

(52) U.S. Cl.

CPC ..... *B63J 2/00* (2013.01); *B63B 13/00* (2013.01); *B63J 2/12* (2013.01); *B63B 35/44* (2013.01); *B63B 2035/448* (2013.01); *B63B 2035/4473* (2013.01); *B63J 2002/005* (2013.01)

(58) Field of Classification Search

CPC ..... E21B 17/01; E21B 17/017; E21B 19/004; B63B 13/00; B63J 2/00; B63J 2/12

See application file for complete search history.

(56) References Cited

U.S. PATENT DOCUMENTS 3,313,345 A * 4/1967 Fischer ..... E21B 7/128 166/355
4,231,312 A * 11/1980 Person ..... F03G 7/05 114/264
4,273,068 A * 6/1981 McNary ..... B63B 35/003 114/264
4,281,614 A * 8/1981 McNary ..... B63B 27/36 114/264
4,294,564 A * 10/1981 Person ..... B63B 35/003 114/264
5,447,392 A * 9/1995 Marshall ..... E21B 19/006 405/224.4
6,161,620 A * 12/2000 Cox ..... E21B 19/004 166/367

(Continued)

FOREIGN PATENT DOCUMENTS

CA 2814912 A1 5/2012
GB 2532735 A 6/2016

(Continued)

*Primary Examiner* — Matthew R Buck
(74) *Attorney, Agent, or Firm* — Nixon & Vanderhye

(57) ABSTRACT

A slide-in structural interface between a Sea Water Intake Riser (SWIR) and a floating unit hull or sump tank bottom plate permits a pull-in, diver-less installation of the SWIR. Certain embodiments include an integrated, easily maintainable strainer.

17 Claims, 6 Drawing Sheets

(56) References Cited

U.S. PATENT DOCUMENTS

| | | | | |
|---|---|---|---|---|
| 6,648,074 | B2 * | 11/2003 | Finn | B63B 21/50 166/350 |
| 8,021,081 | B2 * | 9/2011 | Crotwell | E21B 19/002 405/223.1 |
| 9,562,403 | B2 * | 2/2017 | Otten | E21B 19/002 |
| 2003/0138299 | A1 | 7/2003 | Eide et al. | |
| 2005/0099002 | A1 | 5/2005 | Sanches et al. | |
| 2009/0078425 | A1 | 3/2009 | Wajnikonis et al. | |
| 2014/0059825 | A1 * | 3/2014 | Riggs | F16L 3/00 29/426.1 |

FOREIGN PATENT DOCUMENTS

| | | | |
|---|---|---|---|
| GB | 2532736 | A | 6/2016 |
| WO | 02102653 | A1 | 12/2002 |
| WO | 03006783 | A1 | 1/2003 |
| WO | 03104604 | A1 | 12/2003 |
| WO | 03104605 | A1 | 12/2003 |
| WO | 2004085238 | A1 | 10/2004 |
| WO | 2008017937 | A1 | 2/2008 |
| WO | 2010010500 | A1 | 1/2010 |
| WO | 2011118228 | A1 | 9/2011 |
| WO | 2012066040 | A1 | 5/2012 |
| WO | 2015150416 | A1 | 10/2015 |
| WO | 2015197663 | A1 | 12/2015 |
| WO | 2015197666 | A1 | 12/2015 |
| WO | 2015197875 | A1 | 12/2015 |
| WO | 2016144158 | A1 | 9/2016 |

* cited by examiner

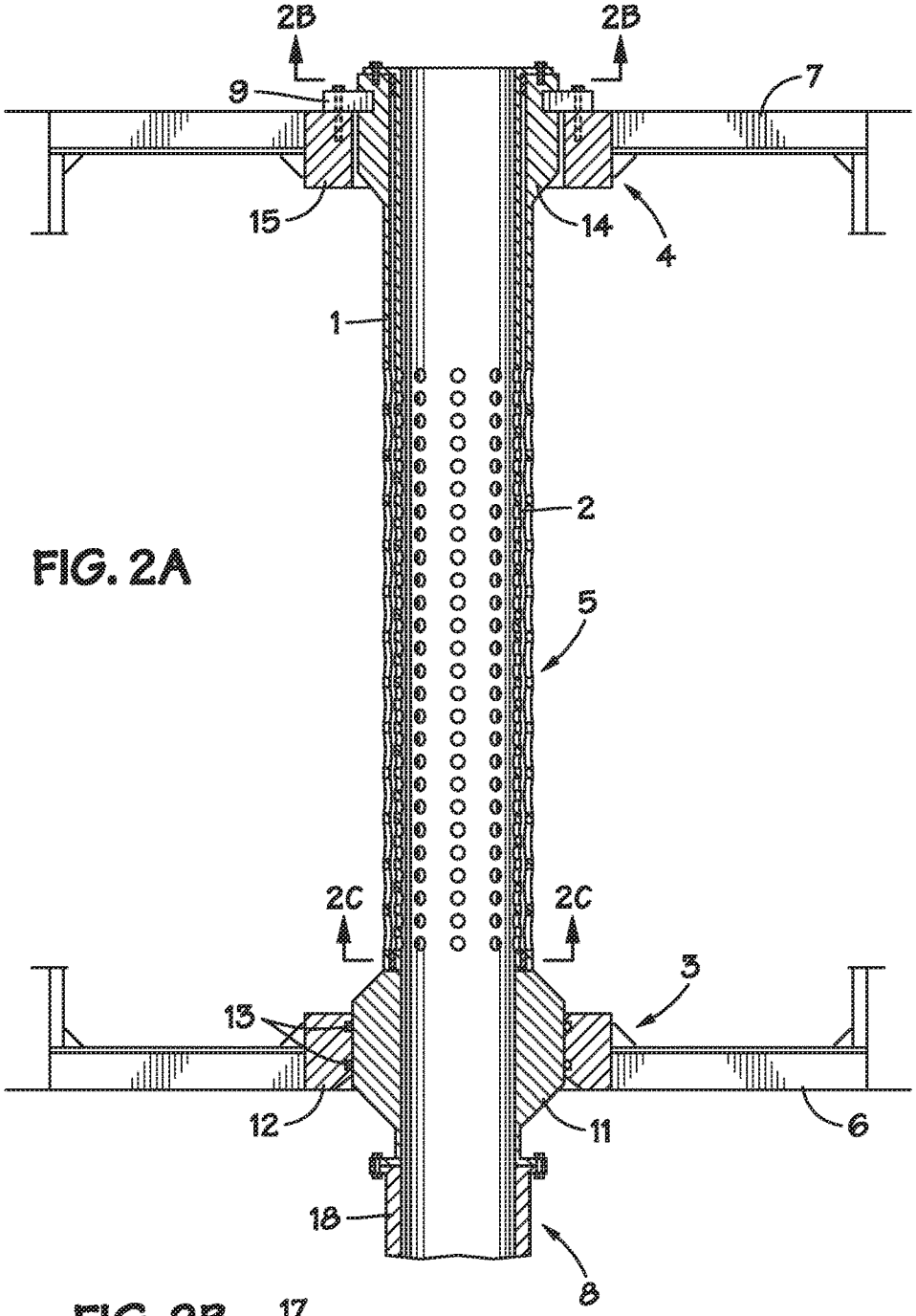
FIG. 2A
FIG. 2B
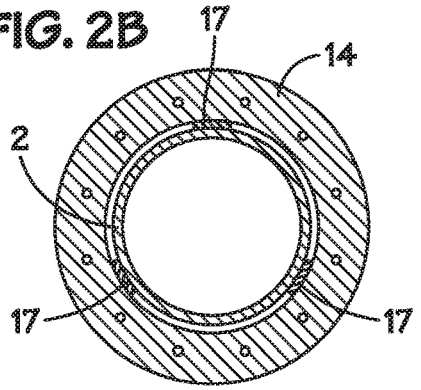
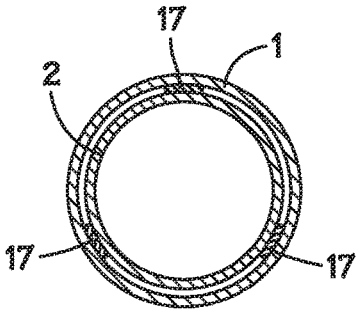
FIG. 2C

SEAWATER INTAKE RISER INTERFACE WITH VESSEL HULL

CROSS-REFERENCE TO RELATED APPLICATIONS

This application claims the benefit of U.S. Provisional Patent Application No. 62/420,188 filed on Nov. 10, 2016, the contents of which are hereby incorporated by reference in their entirety.

STATEMENT REGARDING FEDERALLY SPONSORED RESEARCH OR DEVELOPMENT

Not Applicable

BACKGROUND OF THE INVENTION

1. Field of the Invention

The present invention generally relates to vessels for the offshore production of oil and gas. More particularly, it relates to the seawater intake riser (SWIR) commonly used on such vessels to access colder water than is available at or near the surface.

2. Description of the Related Art Including Information Disclosed Under 37 CFR 1.97 and 1.98

A Seawater Intake Riser (SWIR) or Water Intake Riser (WIR) is a substantially vertical, hanging conduit for the offshore industry, designed specifically for Floating Production Units (e.g., FLNG, FPSO, etc). A seawater intake system provides a means for obtaining low oxygenated water for the cooling, process, utility and/or water injection systems to enhance processing efficiency. In the event a vessel needs to be relocated, the systems are preferably designed to be retrievable within 24 hours.

For example, the FLNG cooling process uses a large volume of cold seawater drawn from 500-3000 feet below the sea surface utilizing several vertical risers (20-in.-60-in. ID) hanging from the vessel. These risers have requirements very different from catenary risers that are supported at hang-off and on the seabed.

The Floating Liquefied Natural Gas (FLNG) units require a large volume of cold seawater to boost the gas liquefaction process efficiency. In order to reach seawater sufficiently cold, seawater intake riser systems are typically 120-1000 meters long and designed for a minimum service life of 25 years.

At 160 meters below the sea surface, the water temperature is typically 10° C. lower than at the surface and up to 16° C. lower at a 320-meter water depth. At 1000 meters below the sea surface, the water temperature may even be as low as 5° C. These depths effectively set the required lengths for the water intake risers to enable an efficient LNG process.

In the past, the installation of SWIRs has required divers and support vessels to assemble and connect the SWIR to an offshore FPSO or FLNG vessel. The present invention provides an apparatus and method that avoids these limitations.

BRIEF SUMMARY OF THE INVENTION

A structural interface according to the invention between a Sea Water Intake Riser (SWIR) and the hull of a floating unit or a sump tank bottom plate permits a pull-in, diver-less installation of the SWIR. Certain embodiments include an integrated, easily maintainable strainer.

BRIEF DESCRIPTION OF THE SEVERAL VIEWS OF THE DRAWING(S)

FIG. 2A is a cross-sectional view of an exemplary second embodiment of the invention.

FIG. 2B is a cross-sectional view taken along line 2B-2B in FIG. 2A.

FIG. 2C is a cross-sectional view taken along line 2C-2C in FIG. 2A.

Figure 11C:
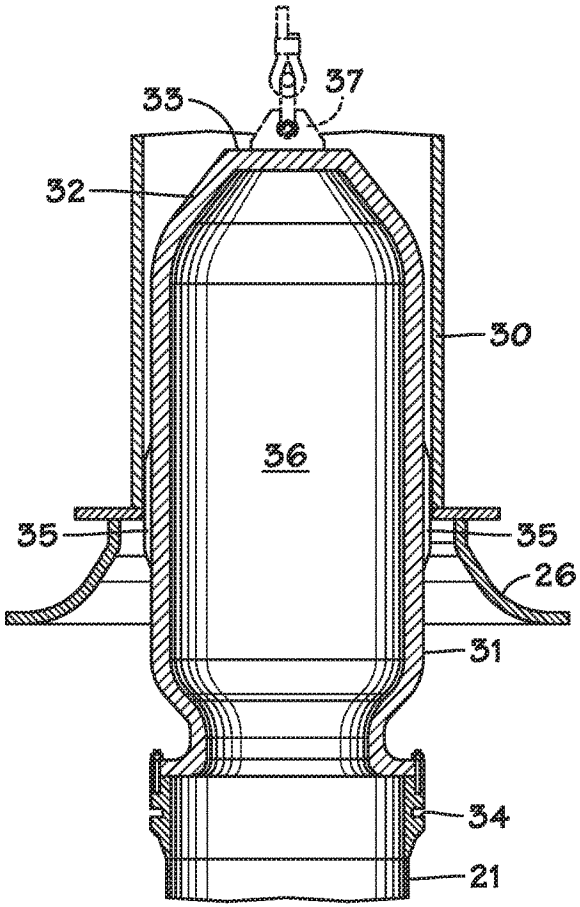
Figure 11B:
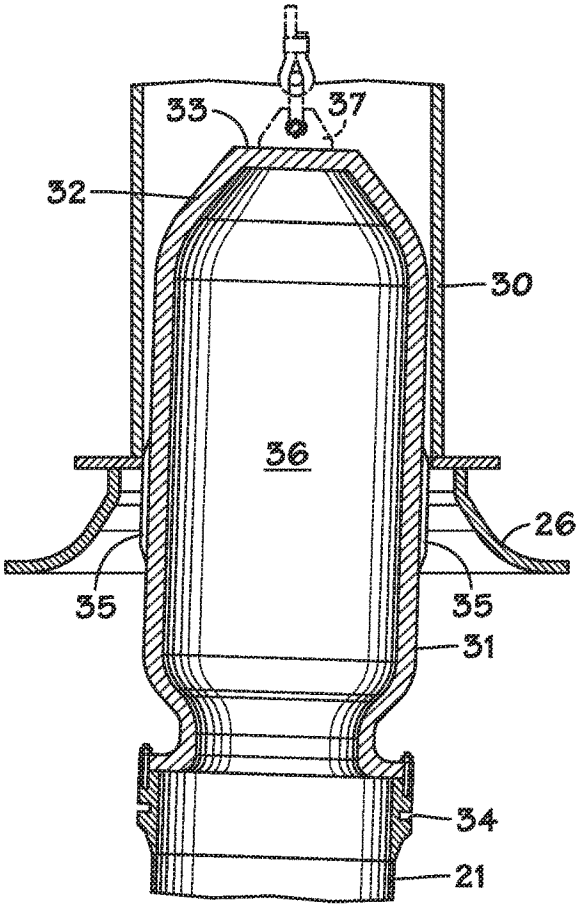
Figure 11A:
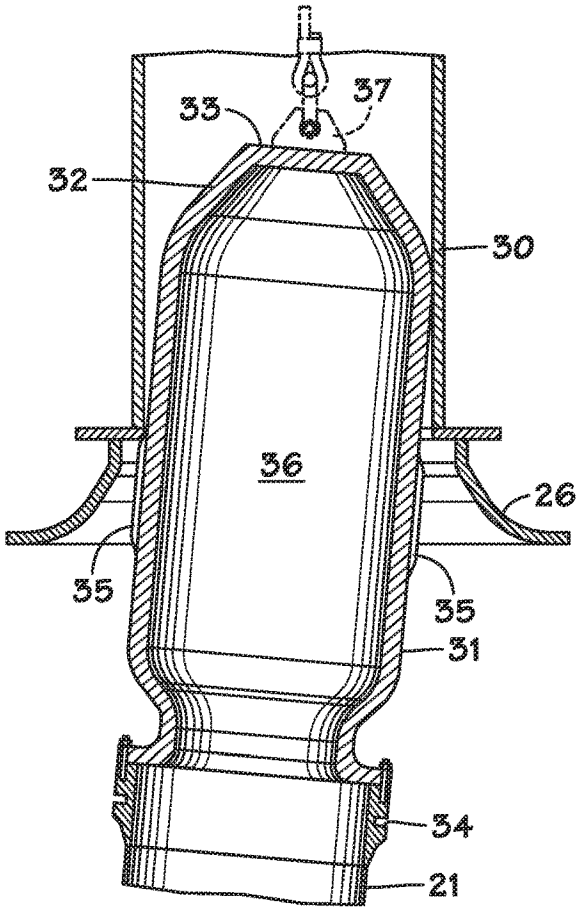

FIGS. 11A-11C sequentially illustrate the alignment which may occur during a SWIR pull-in operation according to a method of the invention.

DETAILED DESCRIPTION OF THE INVENTION

A SWIR may comprise a long, substantially vertical pipe hung from a floating vessel. In certain embodiments, the lower portion (19) may be a polymer pipe such as high-density polyethylene (HDPE) pipe. A flex hose (18) or other similar flexible connection may connect the lower portion (19) of the SWIR to main body (1) of the SWIR interface. In particular exemplary embodiments of the invention illustrated in the drawing figures, the structural interface between a Sea Water Intake Riser (SWIR) and a floating unit hull or sump tank bottom plate may comprise the elements described below.

The SWIR (8) comprises a main cylindrical body (1) perforated in a lower portion (5) located immediately above the sealing device (3). In other embodiments, the perforations extend higher, even to the elevation of the hang-off device (4) [see FIG. 2A].

A cylindrical strainer (2) is coaxial with and inserted into main body (1). Compression fit tabs (17) may be fixed to the inner surface of the outer pipe to positon and hold the inner screen in spaced-apart relation. The strainer (2) may be perforated in the same way as the main body perforations (5) and may include an integrated flow-guiding device (16) configured to minimize the pressure drop through the strainer/main body perforations. The perforations may be extended up to the hang-off device (4). The strainer may be configured to slide into the main body of the structural interface after installation and may then be secured to the main body once into position. Two ring seals (10), one located below and the other above the strainer perforation, may be provided in the annulus to seal between the strainer and main body. In certain embodiments, the ring seals (10) may comprise one or more inflatable seals. In an embodiment, the inside diameter of the strainer (2) is equal to the inside diameter of the male portion (11) of the sealing device (3) so as to provide a smooth transition for the flow of water from the lower part of the SWIR to the perforated section thereof.

A sealing device (3) is located at the penetration with the floating unit hull or sump tank bottom plate (6). The sealing device may comprise two parts: male portion (11); and female portion (12). The male part may be welded to the structural interface main body. The female part may be welded to the hull or sump tank bottom plate. Two ring seals (13) may be located between the male and female bodies to provide a watertight seal between both parts after installation. In certain embodiments, the ring seals (13) may comprise one or more inflatable seals. In an embodiment, the outer diameter (OD) of male portion (11) is equal to or larger than the OD of male portion (14) of the hang off device (4).

A hang-off device (4) may be located at the penetration through the first horizontal hull-supporting structure (7) or sump tank main supporting structure that is located above the lower draft of the floating unit. In an embodiment, the hang-off device comprises three parts: a male part (14); a female part (15); and a split clamp (9). The male part may be welded to the structural interface main body. The female part may be welded to the hull or sump tank main supporting structure. The split clamp may be placed in position and bolted to the female part (15) at the end of a pull-in installation operation in order to secure the structural interface to the hull or sump tank.

A SWIR with a structural interface according to the invention provides the following advantages and benefits over the systems of the prior art:

- It makes possible a pull-in installation of the SWIR through the floating unit hull or sump tank bottom plate;
- Installation does not require diver intervention;
- The strainer may be integrated into the structural interface and therefore maintainable directly from the floating unit; and
- The SWIR exhaust may be integrated into the structural interface allowing the transfer of the seawater from the SWIR to a sump tank without additional devices.

A second, illustrative embodiment is shown in FIG. 2A. This embodiment has an inner screen with perforations that extend substantially along its full length and a correspondingly perforated section of main body 1. The top end of the screen may be closed or perforated in order to permit the flow of seawater when the vessel is operating at a lower draft and the top of the SWIR is below the waterline of the vessel.

Referring now to the embodiment illustrated in FIGS. 3-7, interface pipe 21 is attached to hull structure 20 of a floating vessel having a tank 24 for receiving seawater from a SWIR. The vertical load of the SWIR may be borne by hang-off device 4 of the type described above in connection with the embodiments of FIGS. 1 and 2A. However, in this embodiment, radial loads on the SWIR (such as may be induced by currents or movement of the floating vessel) are reacted by radial load transfer device 22.

Figure 4:
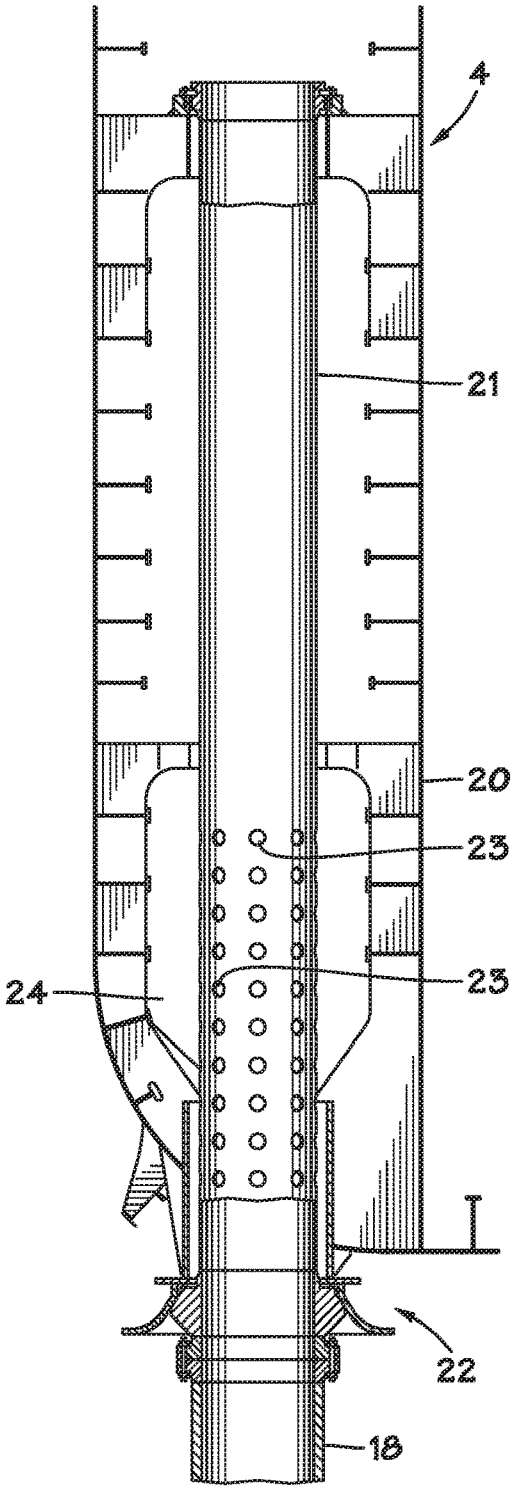
FIG. 4 is an enlarged view of a portion of FIG. 3 with a radial load transfer device shown in cross-section.

As shown in FIG. 4, perforations 23 in interface pipe 21 will admit seawater into tank 4 whenever the level of water in tank 24 is below the waterline of the vessel having hull structure 20.

Figure 7:
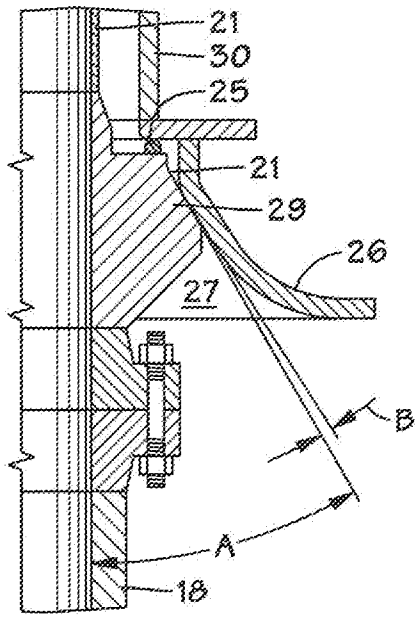
FIG. 7 shows various angular dimensions of one particular embodiment of the radial load transfer device illustrated in FIG. 5.
Figure 6:
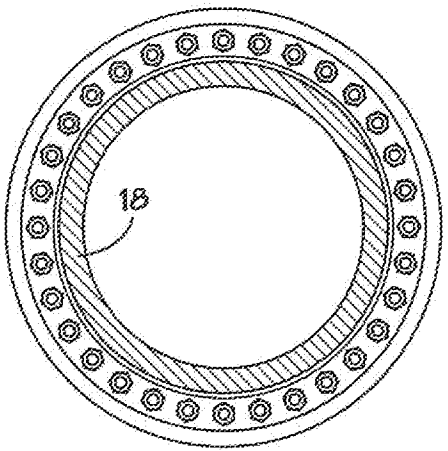
FIG. 6 is a cross-sectional view taken along line 6-6 in FIG. 5.
Figure 5:
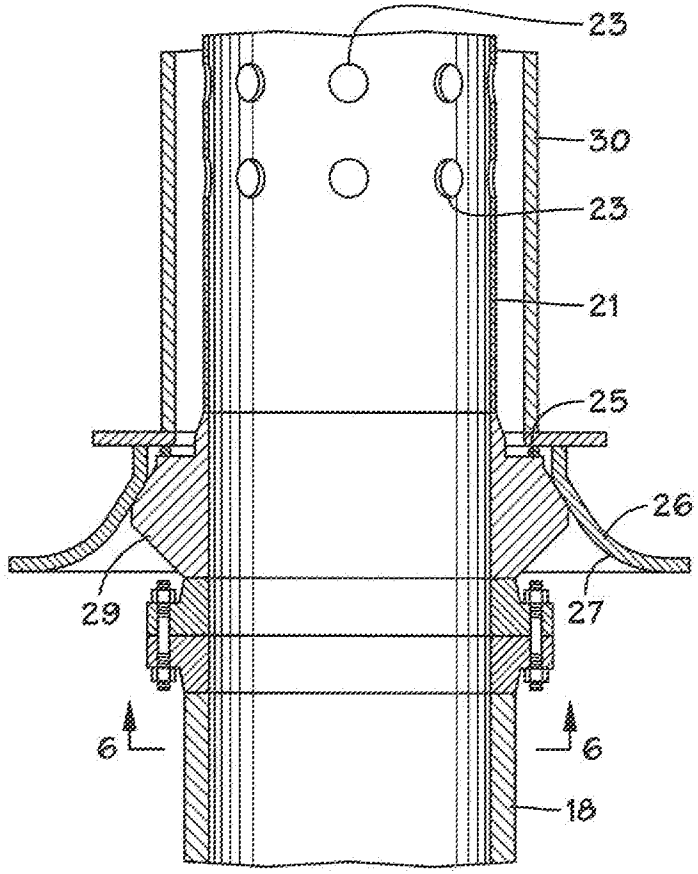
FIG. 5 is a cross-sectional view of the radial load transfer device of the embodiment shown in FIGS. 3 and 4.

FIGS. 5-7 illustrate the details of radial load transfer device 22. One element of the SWIR interface is tubular receiver 30 which has a lower, flared portion 26 having inner tapered surface 27 which forms the female member of the interface. The male portion of the interface is radially enlarged portion 29 of interface pipe 21. Enlarged portion 29 has outer tapered surface 28 which engages tapered surface 27 when fully seated. This engagement may form a metal-to-metal seal sufficient to keep surface water from entering tank 24. Alternatively (or additionally), seal 25 may be provided between a shoulder on the upper end of radially enlarged portion 29 and a corresponding surface on the inside of receiver 30. In an embodiment, seal 25 is a bulb seal.

As illustrated in FIG. 7, it has been found that an angular clearance of 2.5 degrees at B helps to avoid interlocking of the mating conical faces 27 and 28 when the angle A is about 30 degrees.

A coating such as SERMAGARD® [Praxair Surface Technologies, 1500 Polco St. Indianapolis, Ind. 46222 USA] may be applied to selected surfaces of the SWIR interface for corrosion protection.

Figure 10:
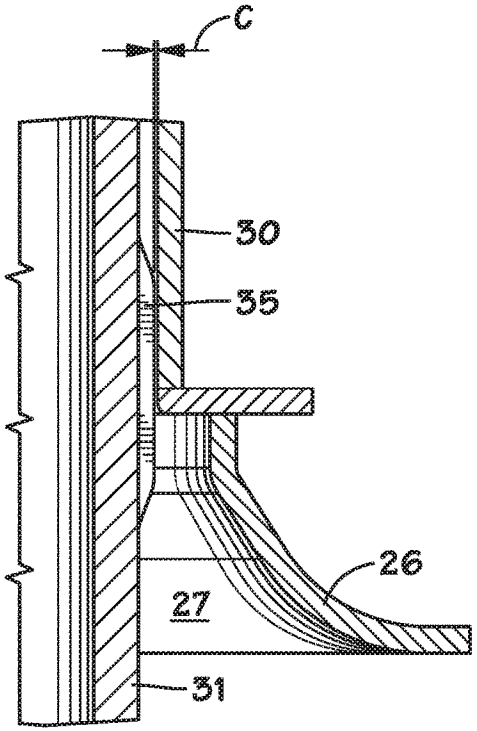
FIG. 10 is an enlarged, cross-sectional view of the interface between the pull-in head and receiver shown in FIG. 8.
Figure 9:
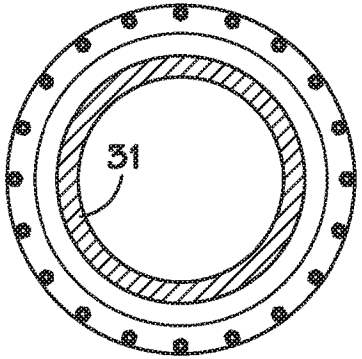
FIG. 9 is a cross-sectional view taken along line 9-9 in FIG. 8.
Figure 8:
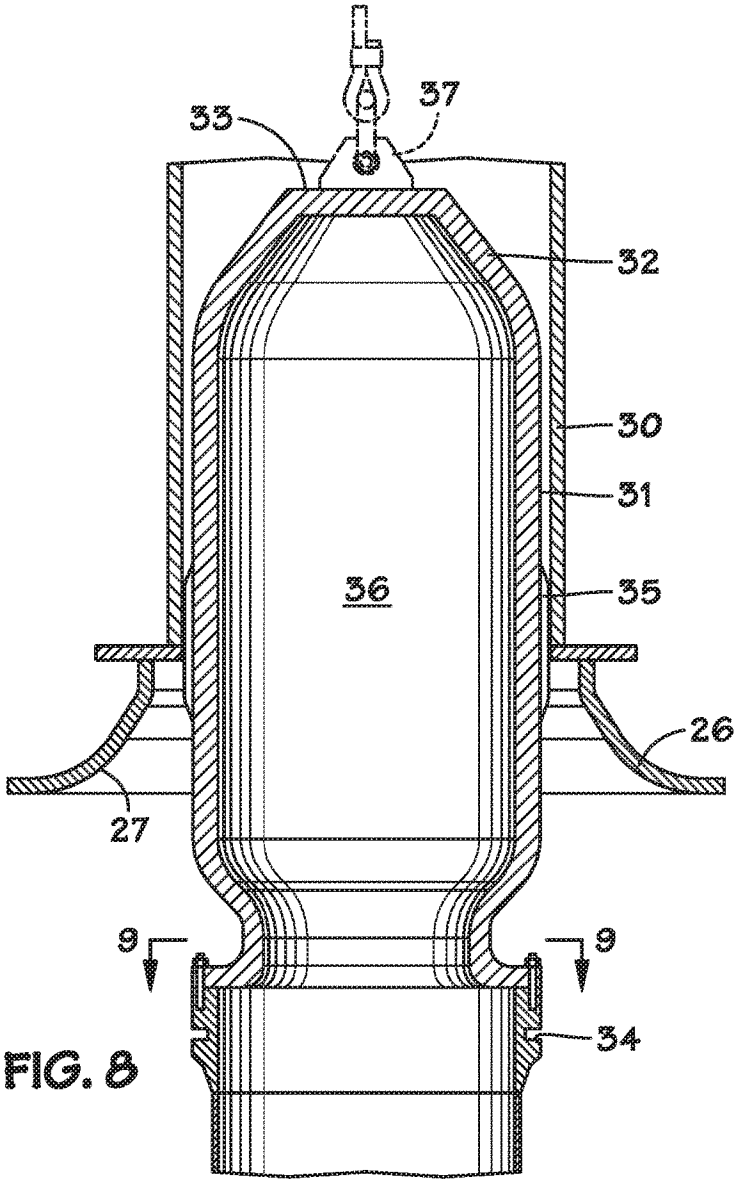
FIG. 8 is a cross-sectional view of a pull-in head attached to a SWIR being drawn into a hull-mounted receiver in a floating vessel.

FIGS. 8-10 illustrate a pull-in head 31 attached to the upper end of a SWIR. The upper end 33 of pull-in head 31 may be equipped with a pad eye 37 or other means for attaching a line for pulling the SWIR into the receiver. Chamfered surface 32 may be provided to accommodate an initial axial misalignment of pull-in head 31 with receiver 30. The interior of pull-in head 30 forms chamber 36 which may be a buoyant chamber. During installation, pull-in head 31 may be raised to an elevation that permits split clamp 9 to be installed in groove 34 at which point pull-in head 31 may be removed from the SWIR.

Segmented alignment tabs 35 may be provided to center pull-in head 31 in receiver 30 while permitting water to escape out the bottom of receiver 30. Clearance C may be provided between the inner surface of receiver 30 and the outer surfaces of tabs 35.

In yet other embodiments (not shown) a cross-load bearing is fitted at the hull penetration and, inasmuch as it may comprise a rubber or elastomer layer compressed between pipe (11) and hull penetration (12), it may also act as the seal element (in view of the low pressure differential involved).

FIGS. 11A, 11B, and 11C sequentially illustrate the axial alignment that may occur when pull-in head 31 is raised in receiver 30.

Figure 1:
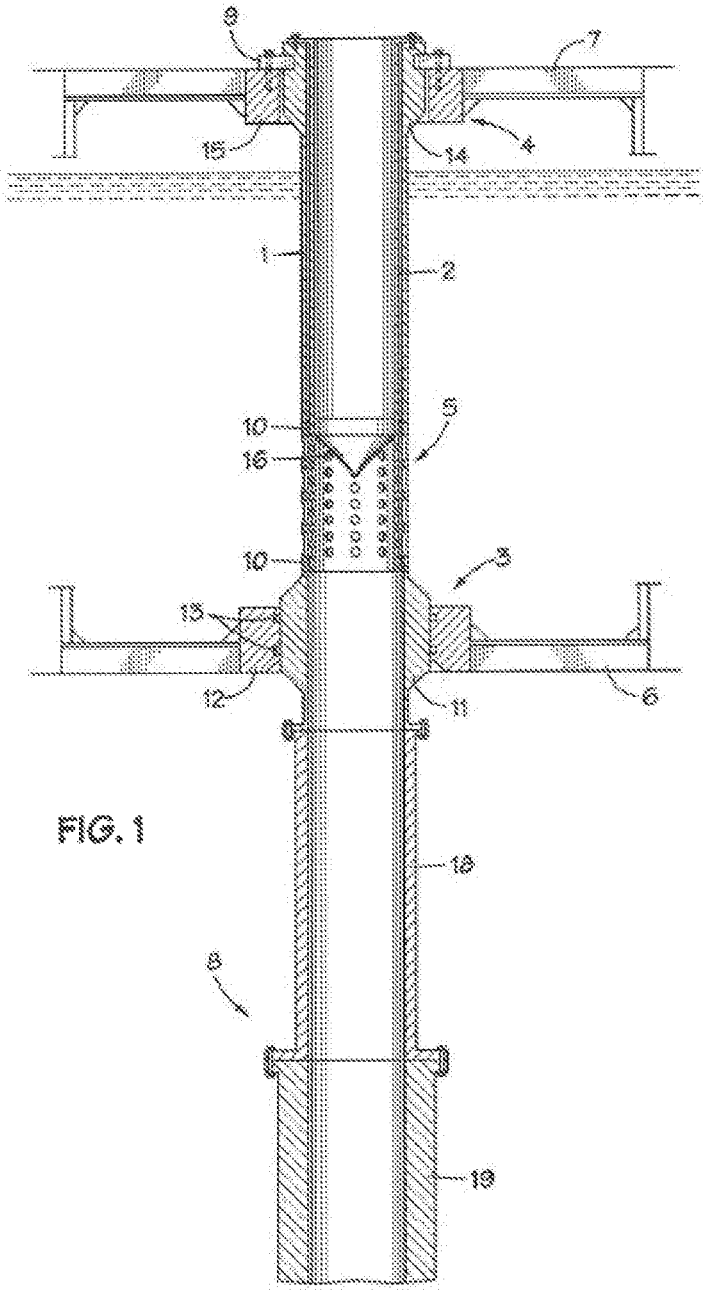
FIG. 1 is a cross-sectional view of an exemplary first embodiment of the invention.
Figure 3:
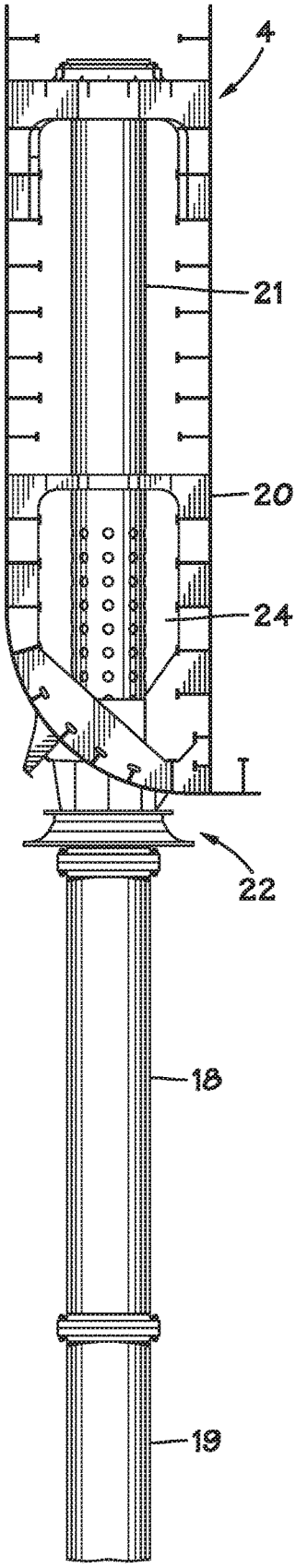
FIG. 3 is a side view, partially in cross-section of an exemplary third embodiment of the invention.

The design of the hang-off device (4) shown in FIG. 1 may also be used in the embodiment illustrated in FIGS. 3 and 4. Similarly, pull-in head 31 shown in FIGS. 8 and 11A-11C may attach to the upper end of interface pipe 21 using the same threaded bores as those shown in FIG. 1 for securing the upper flange on strainer 2 to main body 1.

A method for installing a SWIR on a floating vessel at an offshore location may comprise the following steps:

HDPE pipe 19 is mated to flex hose 18 and interface pipe 21 quayside or at a beach using bolted flanges or other means known in the art. In a protected area, a ballast tank (or multiple ballast tanks) may then be attached proximate the lower end of the SWIR. The resulting SWIR assembly may then be towed by one or more support vessels to the location of an FPSO or other receiving vessel. In an embodiment, towing is performed by two anchor handling vessels (AHV), one at each end of the assembly, to provide a higher degree of control of the floating SWIR assembly.

At the site of the offshore vessel, the ballast tanks may be progressively flooded to upend the SWIR. The attachment line is passed from the AHV connected to the upper end of the SWIR to a pull-in device on the FPSO (which may be an in-line winch or strand jack) for final pull-in and seating of the SWIR in the interface.

In the drawing figures, the following reference numbers are used:

1. main body
2. strainer
3. sealing device
4. hang-off device
5. main body & strainer perforations
6. hull or sump tank bottom plate
7. first horizontal hull or sump tank main supporting structure immediately above the floating unit lower draft
8. Sea Water Intake Riser (SWIR)
9. split clamp
10. ring seals
11. sealing device (male part)
12. sealing device (female part)
13. ring seals
14. hang-off device (male part)
15. hang-off device (female part)
16. flow guiding device (flow diverter)
17. compression fit tabs
18. flex hose
19. HDPE pipe
20. hull structure
21. interface pipe
22. radial load transfer device
23. perforations
24. tank
25. seal
26. flared portion of receiver (female member)
27. inner tapered surface
28. outer tapered surface
29. radially enlarged portion of 21 (male member)
30. receiver
31. pull-in head
32. chamfered surface
33. upper end
34. groove for split clamp
35. segmented alignment tabs
36. chamber
37. pad eye The foregoing presents particular embodiments of a system embodying the principles of the invention. Those skilled in the art will be able to devise alternatives and variations which, even if not explicitly disclosed herein, embody those principles and are thus within the scope of the invention. Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A structural interface between a Seawater Intake Riser (SWIR) and a hull or a sump tank bottom plate of a floating vessel, the structural interface comprising:

a plurality of elements comprising a sealing device located at a penetration in the vessel hull or the sump tank bottom plate, the sealing device comprising a male portion and female portion, the female portion being connected to the vessel hull or the sump tank bottom plate;

a main cylindrical body having a perforated lower portion that is located above the sealing device, the male portion of the sealing device being connected to the main cylindrical body;

a cylindrical strainer that is coaxial with and inserted into the main cylindrical body;

a first annular seal located below a perforated section of the cylindrical strainer in an annulus between the main cylindrical body and the cylindrical strainer;

a second annular seal located above the perforated section of the cylindrical strainer in the annulus between the main body and the cylindrical strainer;

at least one ring seal located between the male and female portions and configured to provide a water-tight seal between the male portion and the female portion; and a hang-off device located at a penetration through a first horizontal hull-supporting structure that is located above a lower draft of the vessel, the hang-off device comprising a male part connected to the main body, a female part connected to the first horizontal hull-supporting structure, and a split clamp configured to lock the male part vertically in place with respect to the female part;

wherein the elements are sized and configured to permit the SWIR to be pulled into the penetration with the vessel hull or the sump tank bottom plate from below the hull or sump tank bottom plate and into engagement with the female part of the hang off device.

2. The structural interface recited in claim 1, wherein the perforated lower portion is proximate the sealing device.

3. The structural interface recited in claim 1, wherein the perforated lower portion of the main cylindrical body extends to an upper location proximate the hang-off device.

4. The structural interface recited in claim 3, further comprising a perforated top plate on the cylindrical strainer.

5. The structural interface recited in claim 1, further comprising a flow diverter that is integrated within the cylindrical strainer.

6. The structural interface recited in claim 5, wherein the flow diverter comprises a substantially conical surface configured to direct water flowing up in the SWIR towards the perforations in the lower section.

7. The structural interface recited in claim 1 wherein the cylindrical strainer is sized and configured for sliding installation in the main cylindrical body and has an inside diameter substantially equal to the inside diameter of the male portion of the sealing device.

8. The structural interface recited in claim 1, further comprising a plurality of compression fit tabs on the inner surface of the main cylindrical body sized and configured to hold the strainer in spaced-apart relation to the main cylindrical body.

9. The structural interface recited in claim 1, wherein the at least one ring seal is an inflatable seal.

10. The structural interface recited in claim 1, wherein at least one of the first annular seal and the second annular seal is an inflatable seal.

11. The structural interface recited in claim 1, wherein the outside diameter of the male portion of the sealing device is larger than the outside diameter of the male portion of the hang-off device.

12. The structural interface recited in claim 1, wherein the strainer is integrated in the structural interface.

13. A method of installing a Sea Water Intake Riser (SWIR) on an offshore floating vessel comprising:

mating a high-density polyethylene (HDPE) pipe to a flex hose and an interface pipe quayside or at a beach;

attaching one or more ballast tanks proximate a lower end of the SWIR;

attaching a pull-in head to an upper end of the SWIR to form a SWIR assembly;

towing the SWIR assembly to the location of the offshore floating vessel;

upending the SWIR proximate the offshore vessel by progressively flooding the ballast tanks;

passing an attachment line connected to the upper end of the SWIR from a support vessel to a pull-in device on the floating vessel equipped with a structural interface according to claim 1; and seating the SWIR in the interface.

14. A structural interface between a Seawater Intake Riser (SWIR) and a hull or a sump tank bottom plate of a floating vessel, the structural interface comprising:

a radial load transferring device comprising a first substantially conical surface attached to the hull or the sump tank bottom plate of the floating vessel, and a second substantially conical surface;

an interface pipe perforated in a lower portion located above the radial load transferring device, the interface pipe comprising a radially extending portion, the second substantially conical surface of the radial load transferring device being on the radially extending portion of the interface pipe; and a hang-off device located at a penetration through a first horizontal hull-supporting structure that is located above a lower draft of the vessel, the hang-off device comprising: a male part, a female part, and a split clamp configured to lock the male part vertically in place with respect to the female part, wherein the radial load transferring device, the interface pipe, and the hang-off device are sized and configured to permit the SWIR to be pulled into the vessel hull or the sump tank bottom plate from below the hull or the sump tank bottom plate and through the radial load transferring device.

15. The structural interface recited in claim 14, wherein the first substantially conical surface and the second substantially conical surface form a metal-to-metal seal when the interface pipe is seated in the radial load transferring device.

16. The structural interface recited in claim 14, further comprising a tubular receiver configured to receive the interface pipe; and a seal between the interface pipe and the tubular receiver.

17. The structural interface recited in claim 14, wherein the first substantially conical surface and the second substantially conical surface have an angular clearance of about 2.5 degrees.

* * * * *